US005417522A

United States Patent [19]

Kono et al.

[11] Patent Number: 5,417,522

[45] Date of Patent: May 23, 1995

[54] SOIL FRAGMENTATION MEMBERS AND MULTIPLE LATERAL SUPPORT STRUCTURES FOR IMPROVED SOIL MIXING AND EFFICIENT BORING FOR USE ON MULTI-SHAFT AUGER SOIL MIXING APPARATUS

[75] Inventors: Ikuo Kono, Tokyo, Japan; David S. Yang, Fremont, Calif.

[73] Assignee: S. M. W. Seiko, Hayward, Calif.

[21] Appl. No.: 125,567

[22] Filed: Sep. 23, 1993

[51] Int. Cl.[6] ..... E02D 3/12; E02D 5/18

[52] U.S. Cl. ..... 405/266; 405/236; 405/240; 405/269

[58] Field of Search ..... 405/266, 267, 269, 232, 405/236–243

[56] References Cited

U.S. PATENT DOCUMENTS

| | | | |
|---|---|---|---|
| 4,084,383 | 4/1978 | Kukino et al. | 405/269 |
| 4,662,792 | 5/1987 | Gessay | 405/269 X |
| 4,886,400 | 12/1989 | Taki et al. | 405/269 X |
| 4,902,172 | 2/1990 | Fukuda | 405/269 |
| 4,906,142 | 3/1990 | Taki et al. | 405/267 |
| 4,909,675 | 3/1990 | Taki | 405/267 |
| 5,013,185 | 5/1991 | Taki | 405/128 |
| 5,047,086 | 9/1991 | Hayakawa et al. | 106/731 |
| 5,118,223 | 6/1992 | Taki | 405/267 |
| 5,163,784 | 11/1992 | Kunito | 405/266 X |

FOREIGN PATENT DOCUMENTS

| | | | |
|---|---|---|---|
| 0101618 | 8/1980 | Japan | 405/269 |
| 0050217 | 3/1983 | Japan | 405/269 |
| 0054121 | 3/1983 | Japan | 405/269 |

*Primary Examiner*—Dennis L. Taylor
*Attorney, Agent, or Firm*—Workman, Nydegger & Seeley

[57] ABSTRACT

An apparatus for constructing subterranean structures, soil-chemicals mixture or soil-agents mixture by using a multi-shaft auger machine to mix soil with a chemical hardener in situ in a borehole. As the auger shafts of the multi-shaft auger machine penetrate the soil, a plurality of lateral support structures shear soil and provide additional lateral support. The plurality of lateral support structures are spaced vertically by a length no greater than thirty feet. Additionally, soil fragmentation members attached to the lateral support structures fragment soil reconsolidations to aid in mixing of soil. The soil fragmentation members have a length no greater than the difference between the radius of at least one auger blade and the radius of the shaft and no less than one-third the difference between the radius of at least one auger blade and the radius of the shaft. The shearing and fragmentation of the soil result in a more homogeneous mixture of the chemical hardener and the soil through which the auger passes. In addition, the shearing and fragmentation of the soil reduces the energy necessary for mixing. Prevention of reagglomeration of soil is most beneficially observed in clay or clay-like soils.

11 Claims, 5 Drawing Sheets

SOIL FRAGMENTATION MEMBERS AND MULTIPLE LATERAL SUPPORT STRUCTURES FOR IMPROVED SOIL MIXING AND EFFICIENT BORING FOR USE ON MULTI-SHAFT AUGER SOIL MIXING APPARATUS

BACKGROUND

1. Field of the Invention

The present invention relates to multi-shaft auger systems and processes for mixing soil with a chemical hardener in situ to form soil-cement columns, walls, piles, grids and monolithic blocks of overlapping columns. More particularly, the present invention is directed to improvements in auger shafts which permit more efficient penetration and improved mixing of the chemical hardener with the soil which forms the soil-cement columns, walls, piles, grids, and monolithic block of columns.

2. The Relevant Technology

For a number of years, multi-shaft auger machines have been used to construct soil-cement columns in the ground without having to excavate the soil by boring into the ground, injecting a chemical hardener and mixing the chemical hardener with the soil. These columns are sometimes referred to as "soilcrete" columns. Soilcrete is a term applied to a mixture of soil and a chemical hardener, which sets up as a solid mass, much like concrete. A "soilcrete" column is one of the most common products of in situ mixing of soil and chemical hardener, so it is used as a generic term to describe the hardened product of in situ soil mixing.

The chemical hardener is injected directly into the soil in situ, and mixed with the soil by an auger. The term "chemical hardener" includes any chemicals and agents that can be added and mixed with soil to cause chemical reactions resulting in the formation of soil-cement structural units. Examples of suitable chemicals and agents are: portland cement, lime, fly ash, kiln dust, cement-based hardeners, bitumen, resin, power plant residues, bentonite, salts, acids, sodium and calcium silicates, calcium aluminates, and sulfates. The chemical reactions include pozzolanic reaction (cementation), hydration, ion-exchange, polymerization, oxidation, and carbonation. The results of these chemical reactions include changes in the physical properties of soil such as strength and permeability and/or the change of chemical properties such as the reduction of the toxicity level in contaminated soil or sludge.

The chemical hardener is added in a slurry form. Therefore, the term "slurry" as used herein is defined as including chemical hardener. Cement slurry has also been called cement grout or cement milk in some of the previous techniques.

Upon hardening, the soil-cement columns possess some characteristics of lower strength concrete columns, but they are constructed without the expense and time-consuming process of removing and replacing the soil with concrete. In some cases, non-hardening soil-chemical or soil agent mixtures are also desirable.

Soil-cement columns have been arranged in a variety of patterns depending on the desired application. Soil-cement columns are used to improve the load bearing capacity of soft soils, such as sandy or soft clay soils. The columns are formed deep in the ground to help support surface construction on soft soils.

In other cases, the soil-cement columns have been overlapped to form boundary walls, excavation support walls, low to medium capacity soil-mixed caissons, and for the in situ fixation of contaminated soil or toxic wastes.

To produce soil-cement columns, a multi-shaft auger machine bores holes in the ground and simultaneously mixes the soil with a slurry or slurries of chemical hardener pumped from the surface through the auger shaft to the end of the auger. Multiple columns are prepared while the soil-cement mixture or soil-chemical mixture is still soft to form continuous walls of geometric patterns within the soil depending on the purpose of the soil-cement columns.

Because the soil is mixed in situ and because the soil-cement wall is formed in a single process, the construction period is shorter than for other construction methods. Obviously, the costs of forming soil-cement columns are less than traditional methods requiring excavation of the soil, constructing forms, and then pouring concrete into the forms in order to form the concrete pillars or walls. In addition, because the soil is not removed from the ground, there is comparatively less material produced in situ by such processes that must be disposed of during the course of construction.

FIG. 1 illustrates a conventional multi-shaft auger machine as the machine would appear in operation. Each shaft of the multi-shaft auger machine, is shown generically as shaft 20. The power for rotating the shaft is generated by a motor 26 and transferred to the upper end of each shaft 24 through a gearbox 22. This configuration is an example of a means for rotating the shafts by generating power and transferring the power to the shaft. Auger blades are securely affixed to the lower end of each shaft for boring downward through the soil to auger boreholes.

As the multi-shaft auger machine penetrates the soil, the soil is broken loose and a chemical hardener slurry is injected into the soil. The chemical hardener is be pumped from the surface through the auger shafts, which are hollow, to the lower ends of each shaft. The augers penetrate, break loose, and lift the soil so that it is mixed with the slurry by the action of intermittent soil mixing paddles 28 and intermittent auger blades 30 which are spaced throughout the length of the shaft. The horizontal and vertical mixing of the auger blades 30 and the soil mixing paddles 28 produces a column having a homogeneous mixture of the soil and the chemical hardener.

FIG. 2 illustrates the details of a prior art three-shaft auger machine. The three-shaft auger machine contains two outer shafts 31*a* and 31*b* and a center shaft 32 each having an upper end (not shown) and a lower end shown generally on the two outer shafts as 33*a* and 33*b* and on center shaft as 34. Outer auger blades 36*a* and 36*b* and center auger blades 38 penetrate undisturbed soil as the shafts rotate and propel the shafts downward to auger boreholes. The outer auger blades 36*a* and 36*b* and center auger blades 38 are securely affixed to lower ends 33*a*, 33*b* and 34 of outer shafts 31*a* and 31*b* and center shaft 32. The outer auger blades 36*a* and 36*b* are vertically offset from center auger blades 38. The outer auger blades 36*a* and 36*b* and center auger blade 38 each possess auger cutting edges 40 which cuts into the soil at the bottom of each borehole. Auger teeth 42 are preferably secured to the cutting edge of the first and second auger blades in order to assist in soil penetration in clay or rocky soils.

Generally, each shaft on a multi-shaft auger machine with three or more shafts rotates in a direction opposite the rotation of adjacent shafts. As shown in FIG. 2, auger blade 38 attached to the lower end 34 of center shaft 32 has a spiral configuration opposite the auger blades attached to the lower ends 33*a* and 33*b* of outer shafts 31*a* and 31*b*. Thus, if center shaft 32 rotated in a clockwise direction, outer shafts 31*a* and 31*b* would rotate in a counter-clockwise direction.

During operation the auger machine starts to penetrates downward through the soil. The process of penetrating downward is often referred to as an auguring stroke. As the auger blades move down, the injection of slurry through the auger shaft is initiated. As the slurry exits the auger shaft, it is mixed with the soil by the auger blades and mixing paddles along the length of each auger.

The resulting soil and slurry mixture is referred to as a "column set" or "borehole". The use of the term "borehole" does not necessarily mean that soil is removed to create a hole. Although some soil is deposited on the surface due to expansion of the soil as it is broken loose and mixed, the majority of the soil remains below the surface as it is mixed. Moreover, use of the term "column set" may refer to a single in situ column set formation or it may generically refer to wall formations or continuous large-area soil formations. Such columns are sometimes referred to as "piles". The column set may be extended to form a grid or a monolithic block of overlapping columns.

The mixing ratio of the slurry to the soil is determined on the basis of the soil conditions which are determined and reported prior to commencing the boring of the columns. The soil-slurry mixing ratio is not decided on the basis of the strength conditions of the continuous wall alone, but such factors as the soil type and condition, and the state of ground water are also taken into consideration in order to obtain a mixing ratio which will result in a substantially homogenous wall which has the desired strength and permeability characteristics. In some cases, special chemical slurries are mixed with in situ soil to stabilize and/or solidify various pollutants in the soil—a procedure named in situ solidification and stabilization or in situ fixation.

Slurry is continuously pumped through the center of the auger shaft and mixed with the soil as the augers penetrate and are then withdrawn from the borehole. In a typical process about 60 percent to 80 percent of the slurry is injected as the augers penetrate downward and the remainder is injected as the augers are withdrawn. According to this method, the mixing process is repeated as the augers are withdrawn from the borehole. Auger speed and slurry output quantities are also set to meet the soil conditions of the site and the purposes of soil mixing work.

The resulting mixing of soil and chemical hardener is sometimes referred to as "soilcrete" because the hardener mixture often possesses some physical properties similar to concrete. Nevertheless, use of the term "soilcrete" does not mean that soil is mixed with concrete or that the chemical hardener always contains cement. If cement slurry is used, the preferred term to describe the hardened mixture is soil-cement.

Due to the tremendous forces required to push the shaft downward and to turn the augers and the shaft, as well as the tendency of the multiple shafts to diverge due to varying soil conditions encountered by each shaft, a lateral support structure is provided to prevent diversion of the auger shafts out of a parallel configuration while concomitantly allowing the shafts to rotate. The lateral support structure, generally illustrated at 50, is located about each respective shaft such that the lateral support structure does not rotate as each respective shaft rotates in the soil. As the lateral support structure 50 serves to maintain the auger shafts in a parallel configuration, the lateral support structure must be located fairly near to the lower ends of the shafts where the impact of rocks and varying soil textures has the most effect on the shafts.

The lateral support structure 50 typically takes the form of nonrotating bands 52 surrounding each shaft, stabilizing bars 54 securely connecting the nonrotating bands to maintain proper shaft alignment and clamps 56*a* and 56*b* securely attached to the nonrotating bands opposite the stabilizer bars 54 to provide additional support.

The nonrotating bands 52 surround the shafts in an area between upper cylindrical collars 58 and lower cylindrical collars 60, the cylindrical collars are formed around the periphery of each shaft. The use of bearings and the configuration of the nonrotating bands and the upper and lower cylindrical collars allow the shafts to rotate within the nonrotating bands 52 while the nonrotating bands remain stationary.

As the augers penetrate new soil, the soil is loosened and forced past the lateral support structure 50 by the action of the rotating auger blades pushing more soil up from below. After passing the lateral support structure, the soil is remixed with mixing paddles attached to the shaft above the lateral support structure.

This auger system works well in sandy or porous soils, however, problems are encountered when auguring in cohesive soils such as clay or silt and with slurries having a low water content. When the auger blades located at the end of each shaft encounter such soils and slurries, the augers shear and fragment the soil only to have the soil reaggregate before passing the lateral support structures which support the shafts. This reaggregation or reagglomeration of soil can form a cylindrical plug which impedes optimal mixing as the plug rotates with the shaft. The natural tendency of cohesive soils such as clay or silt to coalesce is further exacerbated by the injection of the slurry, particularly slurries with a low water content, as the slurry increases the tendency of clay and silt to prematurely reagglomerate.

When sufficient pressure is exerted on the plug by the action of the augers on new soil being forced up from below, the clay plug is forced around the lateral support structure into the area of the borehole above the lateral support structure. Once the cylindrical plug reaches the mixing blades located above the lateral support structure, the cylindrical plug must once again be sheared, fragmented and thoroughly mixed with the slurry. The cylindrical plug reformed beneath the lateral support structure must undergo essentially the same process above the lateral support structure as the process the soil was subjected to below the structure. The mixing blades and paddles located on the shafts above the lateral support structure must not only mix the soil but also reshear and refragment it. The additional shearing and fragmenting results in a reduced rate of progress by the auger machine through the soil. Further, there is significantly less homogenous mixing of the soil with the slurry which results in columns having decreased strength.

The need for shearing and fragmenting the soil and slurry above the support structure requires the use of much more energy which impedes optimal mixing. This energy must be deducted from the total energy available for penetrating new soil layers. This reduction in available energy results in less efficient boring, both in rate of progress through the soil and in the thoroughness of mixing of the soil with the slurry.

From the foregoing, it will be appreciated that what is needed in the art is a multi-shaft auger system for mixing soil with a chemical hardener in situ, which provides for a more homogenous mixture of a chemical hardener slurry and soils when utilized with soils tending to coalesce and with slurries with a low water content.

It would be another advancement in the art to provide a multi-shaft auger system for mixing soil with a chemical hardener in situ, which improves the efficiency of systems utilized in soils tending to coalesce and with slurries with a low water content.

OBJECTS AND BRIEF SUMMARY OF THE INVENTION

It is an object of the present invention to provide apparatus and methods for a multi-shaft auger system for mixing soil with a chemical hardener in situ which yields a homogenous mixture of a chemical hardener slurry and soils when utilized with soils tending to coalesce and with slurries with a low water content.

It is another object of the present invention to provide apparatus and methods for a multi-shaft auger system for mixing soil with chemical hardener in situ which improves the efficiency of systems utilized in soils tending to coalesce and with slurries with a low water content.

To achieve the foregoing objects, and in accordance with the invention as embodied and broadly described herein, a multi-shaft auger system for mixing soil with a chemical hardener in situ is provided in which the multi-shaft auger apparatus comprises at least two substantially parallel shafts, each shaft having an upper end and a lower end.

The shafts are rotated in one configuration by a motor which transfers power through a gearbox attached to the upper end of each shaft. This configuration is an example of a means for rotating the shafts by generating power and transferring the power to the shaft.

At the lower end of each respective shaft, auger blades are securely affixed to facilitate boring downward through the soil as the shafts rotate. The auger blades are capable of penetrating undisturbed soil as the shafts rotate and propelling the shafts downward to auger boreholes. Auger blades are an example of a means for boring downward through the soil to auger a borehole.

As the auger shaft travels downward, the auger blades break up the undisturbed soil and pushes it in an upward direction while concomitantly a chemical hardener slurry is injected into the soil and mixed together. The chemical hardener is pumped from the surface through the auger shafts, which are hollow, to openings formed in the lower end of each of the shafts and in the auger blades which discharge the chemical hardener. This configuration is an example of a means for injecting the chemical hardener into the soil through the shaft during the auger of the borehole. The means for injecting the chemical hardener enables the in situ formation of a hardened soil-cement column set.

The auger shafts are maintained in a parallel configuration by a lateral support structure. The lateral support structure is located about each respective shaft such that the lateral support structure does not rotate as each respective shaft rotates in the soil. The lateral support structure comprises nonrotating bands, at least one stabilizer bar depending on the number of shafts and two clamps. The nonrotating bands surround the shafts in an area between upper cylindrical collars and lower cylindrical collars. The cylindrical collars are formed around the periphery of each shaft. The use of bearings and the configuration of the nonrotating bands and the upper and lower cylindrical collars allow the shafts to rotate within the nonrotating bands while the nonrotating bands remain stationary. Proper spacing between the shafts and proper alignment of the shafts is maintained by the stabilizer bar which securely connects the nonrotating bands. The clamps are securely attached to the nonrotating bands opposite the stabilizer bar to provide additional support.

In one embodiment of the present invention, a plurality of lateral support structures are spaced vertically apart along the shafts to provide more lateral support than merely one lateral support structure. Additionally, when at least two lateral support structures are spaced vertically apart by a length no greater than thirty feet, the undesirable reagglomerated or coalesced plugs formed after passing by the auger blades at the lower end of shaft are sheared. Decreasing the space between the lateral support structures increases the ability of the lateral support structures to shear soils and slurries which typically coalesce below the single support structure of conventional multi-shaft auger machines. Additionally, increasing the ability of the lateral support structures to shear minimizes the rotation of coalesced soils or slurries with the shaft, consequently the homogeneity of the mixtures is improved.

In another embodiment of the present invention, undesirable reagglomerated or coalesced plugs formed after passing by the auger blades at the lower end of the shaft are fragmented by at least one soil fragmentation member secured to a lateral support structure. Fragmentation members are secured to a lateral support structure at an orientation normal to the shafts and protruding radially outward.

Fragmenting the plugs improves the ability of the apparatus to achieve a homogenous mixture as the plugs tend to rotate with the shaft which impedes the mixing process. Homogenous mixtures are desirable as the greater the homogeneity, the greater the strength will be of the columns formed from the mixtures. Additionally, the resistance encountered by the entire apparatus as it passes deeper into the soil is reduced which increases the efficiency of the apparatus.

Soil fragmentation members can be attached to any number of the vertically spaced lateral support structures or only one of the lateral support structures. Additionally, a soil fragmentation member can be placed on either a nonrotating band, a support bar or a clamp.

Intermittent soil mixing paddles and intermittent auger blades are utilized above the lateral support structures to provide horizontal and vertical mixing. Utilization of the soil fragmentation members and a plurality of lateral support structures to fragment and shear the reagglomerated coalesced soil before the soil encounters the intermittent soil mixing paddles and intermittent auger blades improves the ability to achieve homogenous mixtures when utilized in soils tending to coalesce and with slurries having a low water content. The intermittent soil mixing paddles and intermittent auger blades are an example of a means for mixing the chemical hardener with the soil above the support structure.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings and which represent the best mode presently contemplated for implementing the invention. Understanding that these drawings depict only typical embodiments of the invention and are therefore not to be considered limiting of its scope, the invention will be described with additional specificity and detail through the use of the accompanying drawings in which.

DETAILED DESCRIPTION OF THE PREFERRED EMBODIMENTS

The present invention can be best understood with reference to the drawings, wherein like parts are designated with like numerals throughout. The current invention relates to a novel and inventive multi-shaft auger soil mixing apparatus for improved soil mixing and efficient boring, particularly in slurries with a low water content and soils which tend to coalesce such as clay and silt. The effect these type of soils and slurries is a decrease in the homogeneity of the mixture, in the efficiency of the mixing process, and in the rate of penetration of the auger shaft through the soil. An improved auger machine is provided to counteract the deleterious effects of such soils and slurries.

Figure 1:
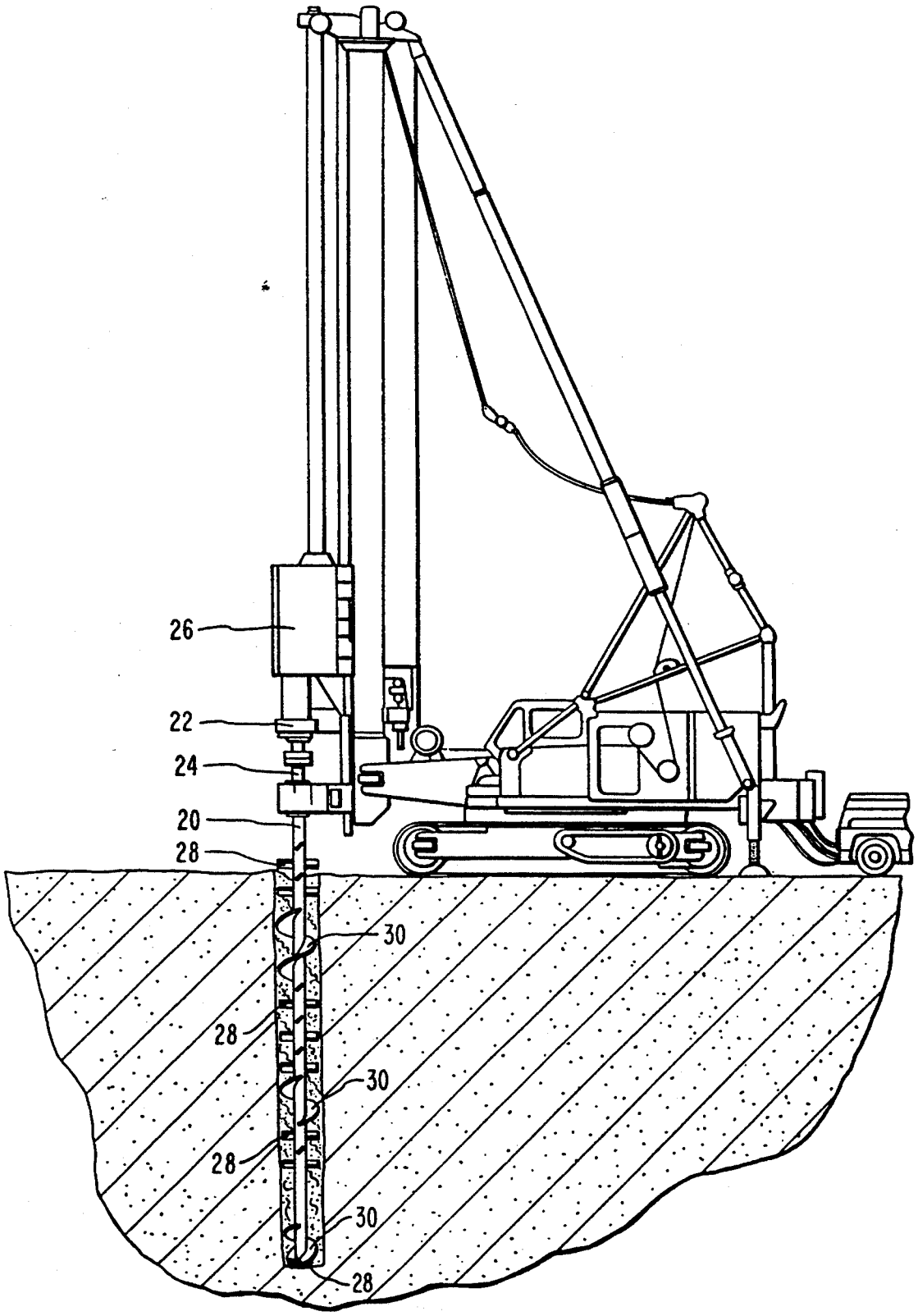
FIG. 1 (PRIOR ART)
FIG. 1 is a vertical cross-sectional view illustrating the environment in which prior art auger shafts operate.
Figure 2:
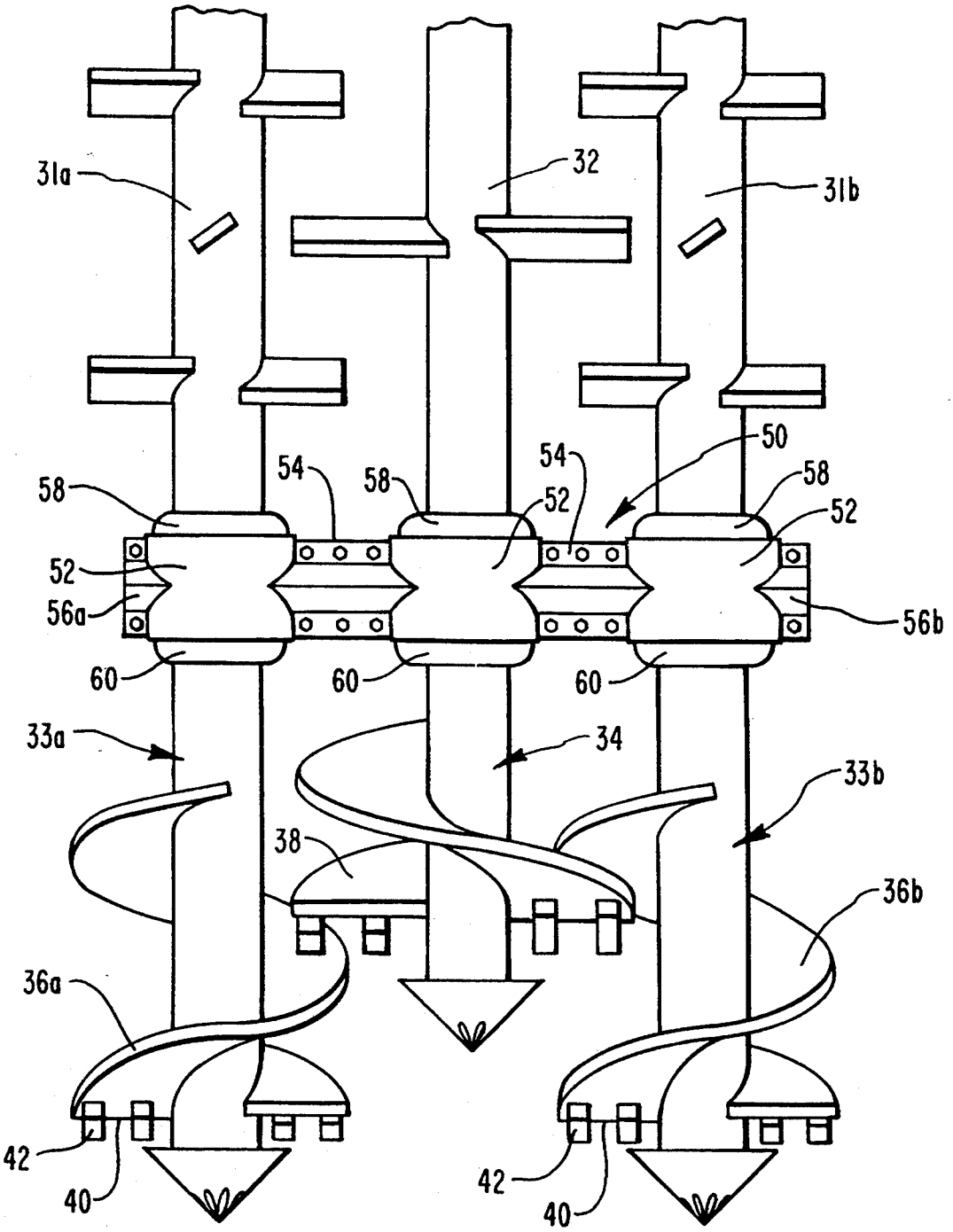
FIG. 2 (PRIOR ART)
FIG. 2 is a perspective view of the lower ends of a three-auger system like those used in the prior art.
Figure 3:
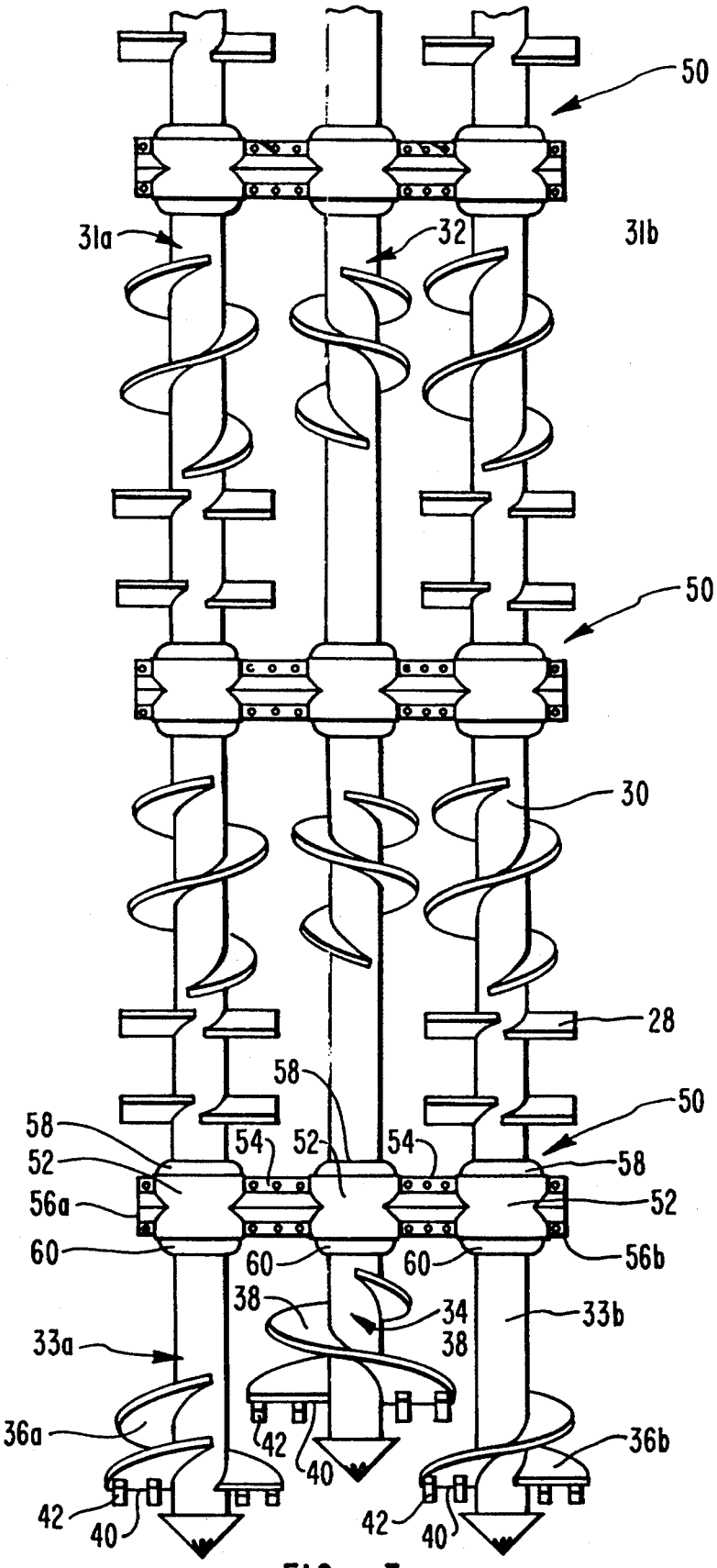
FIG. 3 is an enlarged perspective view of the lower ends of three-auger shafts utilizing the teachings of the present invention wherein the plurality of lateral support structures of the present invention are illustrated.

FIG. 3 illustrates a presently preferred embodiment within the scope of the present invention used in connection with a three-shaft auger machine. Two outer shafts 31*a* and 31*b* and a center shaft 32 each have an upper end (not shown) and a lower end shown generally on the two outer shafts as 33*a* and 33*b* and on center shaft as 34.

The outer shafts and the center shaft are rotated by the power generated by a motor (not shown) and translated to the shafts through a gearbox (not shown) attached to the upper end of each respective shaft. This configuration is an example of a means for rotating the shafts by generating power and transferring the power to the shaft. It will be appreciated that other structures can also be utilized as a means for rotating the shafts.

Outer auger blades 36*a* and 36*b* and center auger blades 38 penetrate undisturbed soil as the shafts rotate and propel the shafts downward to auger boreholes. The outer auger blades 36*a* and 36*b* and center auger blades 38 are securely affixed to lower ends 33*a*, 33*b* and 34 of outer shafts 31*a* and 31*b* and center shaft 32. The outer auger blades are vertically offset from center auger blades. The outer auger blades and the center auger blades each possess an auger cutting edge 40 which cuts into the soil at the bottom of each borehole. Auger teeth 42 are preferably secured to the cutting edge of the first and second auger blades in order to assist in soil penetration in clay or rocky soils. This auger blade configuration provides one example of a means for boring downward through the soil to auger a borehole. It will be appreciated that other embodiments can be utilized as a means for boring downward through the soil to auger a borehole.

As the auger shaft travels downward, the auger blades break up the undisturbed soil and pushes it in an upward direction while concomitantly a chemical hardener slurry is injected into the soil and mixed together. The chemical hardener is pumped from the surface through the auger shafts, which are hollow, to openings formed in the lower end of each of the shafts and in the auger blades which discharge the chemical hardener. This configuration is an example of a means for injecting the chemical hardener into the soil through the shaft during the auger of the borehole. The means for injecting the chemical hardener enables the in situ formation of a hardened soil-cement column set. Other structures, it will be appreciated, can be utilized as a means for injecting the chemical hardener into the soil.

As the slurry is absorbed by the broken soil, mixing becomes more difficult. This is especially true with soils such as clay or silt where the introduction of cement slurry tends to exacerbate the tendency of these soils to clump and coalesce in the form of plugs.

Friction between the sides of the borehole and the edges of the auger blades forces the shafts downward. As the shafts travel downward, the soil through which they pass is mixed and pushed in an upward direction with respect to the downward motion of the shafts. But unlike many auguring devices the soil is not removed from the borehole.

Instead, the position of the soil relative to contiguous soil located outside of the borehole remains relatively constant. It is desirable to continuously remix the soil in an attempt to attain homogeneity of the soil-slurry mixture as the shaft passes through that soil. Continuous mixing can be accomplished by intermittent soil mixing paddles 28 and intermittent auger blades 30 spaced throughout the length of the shaft. The intermittent soil mixing paddles and intermittent auger blades are an example of a means for mixing the chemical hardener with the soil.

The intermittent soil mixing paddles 28 and intermittent auger blades 30 are above a lateral support structure, generally illustrated at 50, which is provided to prevent diversion of the auger shafts out of a parallel configuration while concomitantly allowing the shafts to rotate. The lateral support structure is located about each respective shaft such that the lateral support structure does not rotate as each respective shaft rotates in the soil.

The lateral support structure comprises nonrotating bands 52 surrounding each shaft; stabilizing bars 54 securely connecting the nonrotating bands to maintain parallel shaft alignment; and clamps 56*a* and 56*b*, which are securely attached to the nonrotating bands opposite the stabilizer bars 54 in order to provide additional support. The nonrotating bands 52 surround the shafts in an area between upper cylindrical collars 58 and lower cylindrical collars 60. The cylindrical collars are formed around the periphery of each shaft. The use of bearings and the configuration of the nonrotating bands and the upper and lower cylindrical collars allows the shafts to rotate within the nonrotating bands 52 while the nonrotating bands remain stationary. As the lateral support structure serves to maintain the auger shafts in a parallel configuration, the lateral support structure is generally located near the lower ends of the shafts where the impact of rocks and varying soil textures has the most effect on the shafts.

A plurality of lateral support structures 50 are spaced vertically apart along the shafts to provide more lateral support than merely one lateral support structure. Additionally, it has been determined that when at least two lateral support structures are spaced vertically apart by a length no greater than thirty feet, the undesirable reagglomerated or coalesced plugs formed after passing by the auger blades at the lower end of shaft are sheared. Utilizing multiple lateral support structures creates a shearing effect on the coalesced slurry and soil plugs because the plug cannot continue to rotate with the shaft upon encountering the lateral support structures. The result of minimizing the rotation of coalesced soils or slurries with the shaft is an increase in homogeneity of the mixtures and a more efficient column forming process.

The vertical spacing between the lateral support structures can be varied depending on the type of soil or the water content of the slurry to achieve an optimal mixture. Lateral support structures spaced less than thirty feet apart provide the benefit of shearing the soil or slurry, as well as increasing the lateral support achieved with only one support structure. Decreasing the space between the lateral support structures increases the ability of the lateral support structures to shear soils and slurries which typically coalesce below the single support structure of conventional multi-shaft auger machines. Additionally, the spacing between a pair of adjacent lateral support structures may be different from the spacing of another pair of adjacent lateral support structures.

Figure 4:
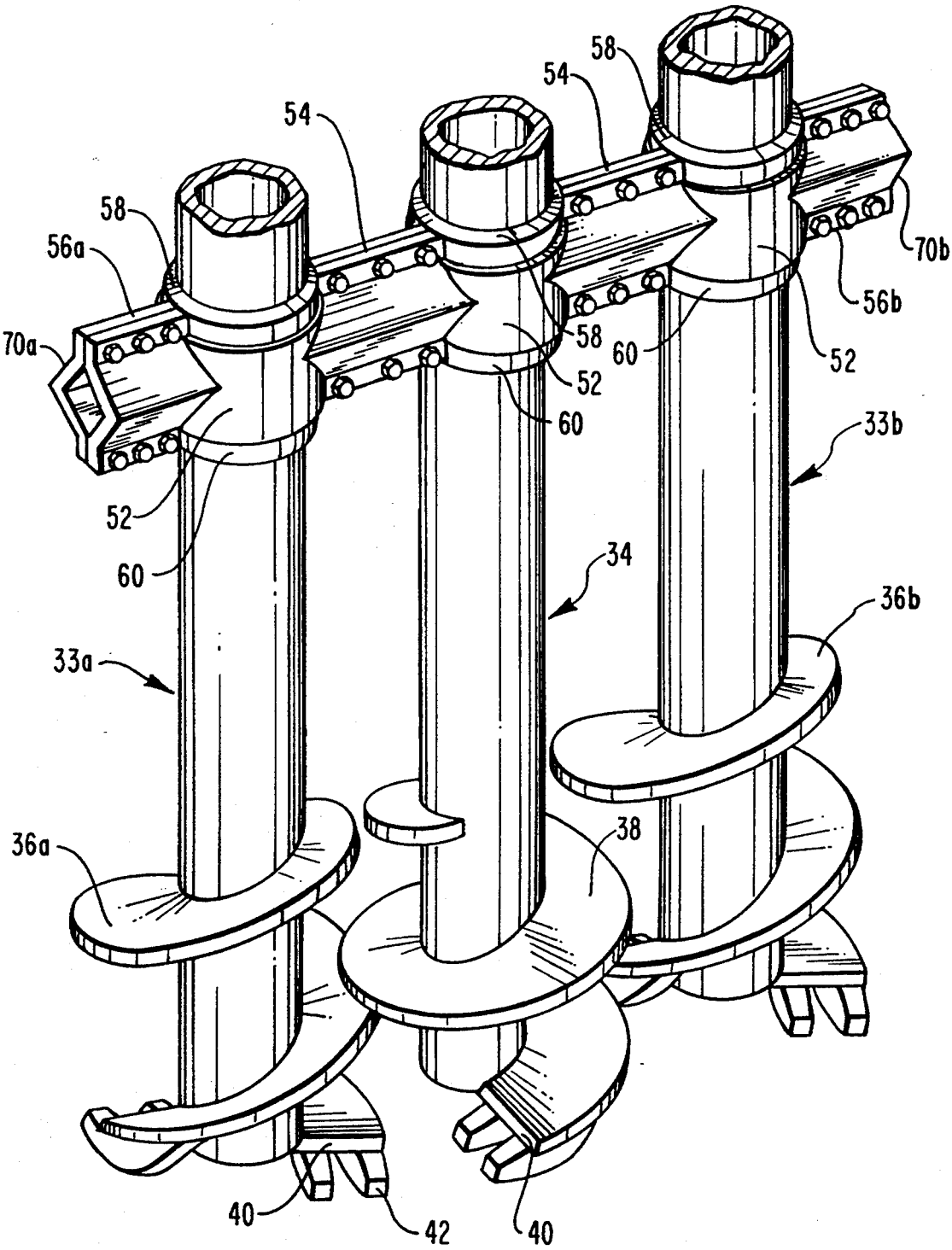
FIG. 4 is a perspective view of the lower ends of three-auger shafts utilizing the teachings of the present invention wherein the fragmentation members of the present invention are illustrated.

In another embodiment of the present invention, undesirable reagglomerated or coalesced plugs formed after passing by the auger blades at the lower end of the shaft are fragmented by at least one soil fragmentation member secured to a lateral support structure. By way of example and not limitation, a fragmentation member in the embodiment illustrated in FIG. 4 comprises two soil fragmentation members 70*a* and 70*b* attached to the two clamps 56*a* and 56*b* at an orientation normal to the shafts and protruding radially outward. The soil fragmentation members serve to fragment soil and slurries which coalesce below the lateral support structures and to minimize the rotation of the coalesced soil or slurry plug with the shaft.

The soil fragmentation members can also be utilized in conjunction with the plurality of vertically spaced lateral support structures as illustrated in FIG. 3. Soil fragmentation members can be attached to any number of the vertically spaced lateral support structures or only one of the lateral support structures.

The length of the soil fragmentation member can be varied depending on the type of soil being mixed and the water ratio of the slurry. Varying the length of the soil fragmentation members allows for optimal in-situ soil mixing by achieving sufficient fragmentation. Additionally, the soil fragmentation members can have a variety of shapes such as a rectangular shape, a pointed end, a curved hook shape and any other useful shape.

Figure 5:
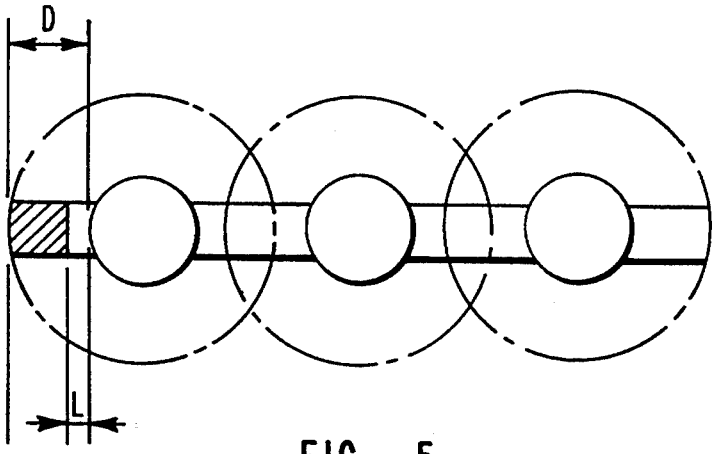
FIG. 5 is a cross-sectional view of the range of possible lengths for a soil fragmentation member.

FIG. 5 is a cross-sectional view of the range of possible lengths for a soil fragmentation member within the scope of the present invention. The length of the soil fragmentation member, represented by reference character L, must be no greater than the difference between the radius of at least one auger blade and the radius of the shaft, represented by reference character D. As used in the specification and appended claims the term "length of the auger blade" is defined as the difference between the radius of the auger blade and the radius of the shaft, represented by the referenced character D in FIG. 5. Additionally, the length of the soil fragmentation member must be no less than one-third the difference between the radius of at least one auger blade and the radius of the shaft. The radius of the auger blades determines the radius of the borehole, consequently utilizing soil fragmentation members with a length no greater than the difference between the radius of at least one auger blade and the radius of the shaft assures that no energy is lost in friction of the soil fragmentation members against the sides of the borehole.

Cohesive soil such as clay or silt and slurries with a low water content necessitates that the soil fragmentation member extend a length which is no less than one-third the difference between the radius of at least one auger blade and the radius of the shaft. Additionally, when mixing clay or silt in a slurry with a low water content requires that the soil fragmentation members extend an even greater length.

Figure 6A:
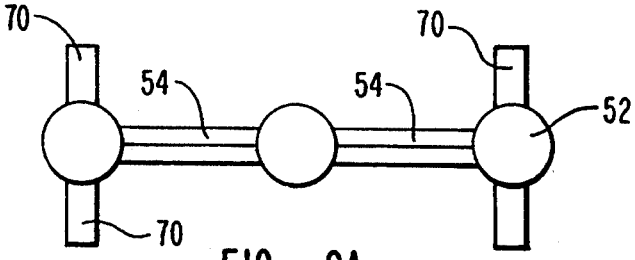
FIG. 6*a* is a cross-sectional view of the support structure with soil fragmentation members attached to the nonrotating bands.
Figure 6B:
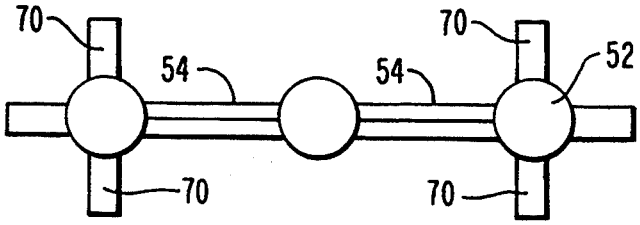
FIG. 6*b* is a cross-sectional view of the support structure with soil fragmentation members attached to the nonrotating bands and the clamps.
Figure 6C:
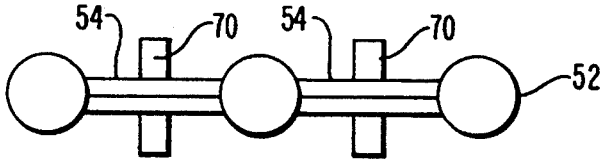
FIG. 6*c* is a cross-sectional view of the support structure with soil fragmentation members attached to the support bar.
Figure 6D:
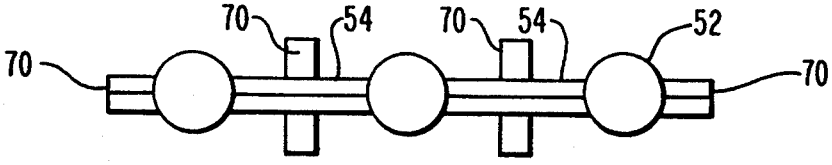
FIG. 6*d* is a cross-sectional view of the support structure with soil fragmentation members attached to the support bar and the clamps.

The soil fragmentation member can be placed on either a nonrotating band, a support bar or a clamp. Cross sections of possible configurations are shown in FIGS. 6*a*–6*d*. FIGS. 6*a* and 6*b* illustrates soil fragmentation members attached to the nonrotating band. FIGS. 6*c* and 6*d* illustrate soil fragmentation members attached to the stabilizer bar.

Soil fragmentation members 70*a* and 70*b* serve to improve the homogeneity of the clay soil by easing the remixing process in the area above the soil fragmentation members 70*a* and 70*b*. By fragmenting the reconsolidated soil, friction caused by remixing large agglomerations is greatly reduced and the efficiency of the boring process through clay soils is greatly increased.

From the foregoing, it can be seen that the present invention provides a multi-shaft auger system for mixing soils with a chemical hardener in situ which fragments reconsolidated soil. The soil fragmentation provides a more homogeneous mixture of a slurry and a clay soil, resulting in stronger columns.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Patent is:

1. A multi-shaft auger apparatus for mixing soil with a chemical hardener in situ in a borehole to form a hardened soil-cement column set, the apparatus comprising:

(a) at least two substantially parallel shafts, the shafts having upper ends and lower ends;

(b) rotation means for rotating the shafts, the rotation means being attached to the upper ends of the shafts;

(c) an auger blade affixed to the lower ends of each of the shafts for boring downward through the soil to auger a borehole, the auger blade having a length;

(d) injection means for injecting the chemical hardener into the soil through the shafts during the auger of the borehole;

(e) a plurality of lateral support structures spaced vertically apart along the shafts to provide lateral support, the lateral support structures being located about the shafts such that the lateral support structures do not rotate as the shafts rotate in the soil; and (f) a fragmentation member extending from each of the lateral support structures at an orientation normal to the shafts and protruding radially outward to aid in fragmenting soil and to aid in mixing the soil with the chemical hardener, the fragmentation member having a length in a range between about $\frac{1}{3}$ to about $\frac{1}{2}$ the length of the auger blade.

2. A multi-shaft auger apparatus for mixing soil with a chemical hardener in situ in a borehole to form a hardened soil-cement column set as recited in claim 1, wherein at least two of the lateral support structures are spaced vertically apart by a length no greater than about thirty feet to shear the soil.

3. A multi-shaft auger apparatus for mixing soil with a chemical hardener in situ in a borehole to form a hardened soil-cement column set as recited in claim 1, wherein the auger apparatus further includes a plurality of fragmentation members extending from each of the lateral support structures.

4. A multi-shaft auger apparatus for mixing soil with a chemical hardener in situ in a borehole to form a hardened soil-cement column set as recited in claim 1, wherein each support structure comprises at least two nonrotating bands, at least one stabilizer bar and two clamps which are integrally connected.

5. A multi-shaft auger apparatus for mixing soil with a chemical hardener in situ in a borehole to form a hardened soil-cement column set as recited in claim 4, wherein the fragmentation member extends from one of the two clamps of the support structure and is an integral portion of one of the two clamps.

6. A multi-shaft auger apparatus for mixing soil with a chemical hardener in situ in a borehole to form a hardened soil-cement column set as recited in claim 4, wherein the fragmentation member extends from one of the nonrotating bands.

7. A multi-shaft auger apparatus for mixing soil with a chemical hardener in situ in a borehole to form a hardened soil-cement column set as recited in claim 4, wherein the fragmentation member extends from the stabilizer bar.

8. A multi-shaft auger apparatus for mixing soil with a chemical hardener in situ in a borehole to form a hardened soil-cement column set as recited in claim 1, further comprising a mixing means for mixing the chemical hardener with the soil above at least one of the lateral support structures.

9. A multi-shaft auger apparatus for mixing soil with a chemical hardener in situ in a borehole to form a hardened soil-cement column set as recited in claim 8, wherein the mixing means comprises at least one auger blade affixed to each of the shafts and a plurality of soil mixing paddles affixed to each of the shafts.

10. A method for in situ formation of a subterranean structure in soil using a multi-shaft auger apparatus having shafts to mix a chemical hardener with soil, the method comprising the steps of:

(a) auguring a borehole downward into and through the soil with an auger apparatus having at least two substantially parallel shafts configured to rotate in the soil with auger blades at the lower end of each respective shaft, the auger blades having a length;

(b) injecting the chemical hardener through the shaft and into the soil during the auger of the borehole;

(c) shearing the soil with a plurality of lateral support structures spaced vertically apart along the shafts to provide lateral support, each lateral support structure being located about each respective shaft such that the lateral support structures do not rotate as each respective shaft rotates in the soil, wherein at least two lateral support structures are spaced vertically apart by a length no greater than thirty feet to shear the soil; and (d) fragmenting soil lifted upwardly by the multi-shaft auger apparatus with at least one soil fragmentation member extending from each of the lateral support structures at an orientation normal to the shafts and protruding radially outward to aid in fragmenting soil and to aid in mixing the soil with the chemical hardener, the fragmentation member having a length in a range between about $\frac{1}{3}$ to about $\frac{1}{2}$ the length of the auger blade;

(e) mixing the soil within the borehole with the chemical hardener;

(f) allowing the soil and chemical hardener blend to cure to form a hardened subterranean structure.

11. A method for in situ formation of a subterranean structure as recited in claim 10, further comprising a step of withdrawing the multi-shaft auger apparatus from the borehole while simultaneously blending the soil with the chemical hardener.

* * * * *